US005954943A

United States Patent [19]

Tong et al.

[11] Patent Number: 5,954,943

[45] Date of Patent: Sep. 21, 1999

[54] METHOD OF INHIBITING COKE DEPOSITION IN PYROLYSIS FURNACES

[75] Inventors: Youdong Tong, Houston; Michael K. Poindexter, Sugar Land, both of Tex.

[73] Assignee: Nalco/Exxon Energy Chemicals, L.P., Sugar Land, Tex.

[21] Appl. No.: 08/932,588

[22] Filed: Sep. 17, 1997

[51] Int. Cl.[6] ..... C10G 75/00; C10G 9/16

[52] U.S. Cl. ..... 208/48 R; 208/48 AA; 208/132; 585/648; 585/650

[58] Field of Search ..... 208/48 R, 48 AA, 208/106, 132; 585/950, 648, 651

[56] References Cited

U.S. PATENT DOCUMENTS

| | | | |
|---|---|---|---|
| 3,405,054 | 10/1968 | Arkis et al. | 208/48 AA |
| 3,531,394 | 9/1970 | Koszman . | |
| 3,647,677 | 3/1972 | Wolff et al. . | |
| 4,024,050 | 5/1977 | Shell et al. . | |
| 4,024,051 | 5/1977 | Shell et al. . | |
| 4,105,540 | 8/1978 | Weinland . | |
| 4,116,812 | 9/1978 | Godar et al. . | |
| 4,226,700 | 10/1980 | Broom | 208/48 AA |
| 4,425,223 | 1/1984 | Miller | 208/48 AA |
| 4,542,253 | 9/1985 | Kaplan et al. . | |
| 4,551,227 | 11/1985 | Porter et al. . | |
| 4,775,459 | 10/1988 | Forester | 208/48 AA |
| 4,835,332 | 5/1989 | Kisalus . | |
| 4,840,720 | 6/1989 | Reid | 208/48 AA |
| 4,927,519 | 5/1990 | Forester | 208/48 AA |
| 5,139,643 | 8/1992 | Roling et al. | 208/48 AA |
| 5,354,450 | 10/1994 | Tong et al. . | |
| 5,360,531 | 11/1994 | Tong et al. . | |
| 5,446,229 | 8/1995 | Taylor et al. . | |
| 5,463,159 | 10/1995 | Callejas et al. . | |
| 5,565,087 | 10/1996 | Brown et al. | 208/48 R |

OTHER PUBLICATIONS

Effect of Benzene and Thiophene on Rate of Coke Formation during Naphtha Pyrolysis, D. Sahu/D. Kunzru, The Canadian Journal of Chemical Engineering, vol. 66, 808–816, Oct. 1988.

Influence of Metal Surface and Sulfur Addition on Coke Deposition in the Thermal Cracking of Hydrocarbons, M.S.G. Reyniers/G. F.Froment, Ind. Eng. Chem. Res., vol. 34, 773–785, 1995.

Inhibition of Coke Formation in Pyrolysis Furnaces, Y. Tong, et al., Symposium on Coke Formation and Mitigation, 612–617, Division of Petroleum Chemistry, Aug. 1995.

Organophosphorus Compounds as Coke Inhibitors during Naphtha Pyrolysis. Effect of Benzyl Diethyl Phosphite and Triphenylphosphine Sulfide, P. Das, et al., Ind. Eng. Chem. Res., vol. 31. No. 9, 2251–2255, 1992.

Pure n–Nonane Steam Cracking and the Influence of Sulfur Compounds, D. Depeyre et al., Ind. Eng. Chem. Des. Dev., vol. 24, No. 4, 920–924, 1985.

Pyrolysis of Hydrocarbons in the Presence of Elemental Sulfur, M. Bajus et al., Collection Czechoslov. Chem. Commun., vol. 45, 238–254, 1980.

Pyrolysis of Propane in Tubular Flow Reactors, B. L. Crynes et al., I&EC Process Design and Development, vol. 8, 25–31, Jan. 1969.

Reduction of Coke Formation During Naphtha Pyrolysis Using Triethyl Phosphite, K.K. Ghosh et al., Ind. Eng. Chem. Res., vol. 27, 559–565, 1988.

Steam Cracking of Hydrocarbons. 6. Effect of Dibenzyl Sulfide and Dibenzyl Disulfide on Reaction Kinetics and Coking; M. Bajus et al., Ind. Eng. Chem. Prod. Res. Dev., vol. 22, 335–343, 1983.

Triphenyl Phosphite as a Coke Inhibitor during Naphtha Pyrolsis, S. Vaish et al., Ind. Eng. Chem. Res., vol. 28, 1293–1299, 1989.

*Primary Examiner*—Bekir L. Yildirim
*Attorney, Agent, or Firm*—Kelly L. Cummings; Thomas M. Breininger

[57] ABSTRACT

A method is disclosed for reducing coke deposition in a pyrolysis furnace which comprises treating the pyrolysis furnace with a combination of sulfur- and phosphorus-containing compounds having a total sulfur to phosphorus atomic ratio of at least 5.

10 Claims, 9 Drawing Sheets

METHOD OF INHIBITING COKE DEPOSITION IN PYROLYSIS FURNACES

FIELD OF THE INVENTION

This invention relates generally to ethylene manufacture and, more particularly, to a method of inhibiting coke deposition in pyrolysis furnaces.

BACKGROUND OF THE INVENTION

Ethylene manufacture entails the use of pyrolysis furnaces (also known as steam crackers or ethylene furnaces) to thermally crack various gaseous and liquid petroleum feedstocks to ethylene and other useful products. Typical gaseous feeds to the pyrolysis furnaces include ethane, propane, butane and mixtures thereof. Typical liquid feedstocks to pyrolysis furnaces include naphtha, kerosene, gas oil, and other petroleum distillates.

The petroleum feedstocks are cracked in the tube reactors of the pyrolysis furnace at temperatures ranging from 700 to 1000° C. Steam is generally injected in addition to the feed during the cracking reaction to control undesired reactions/processes, such as coke formation. In the typical operation of a pyrolysis furnace, the petroleum feedstocks and the steam are mixed and preheated through the convection section of the pyrolysis furnace.

Cracking of the petroleum feedstocks occurs in the radiant section of the pyrolysis furnace. The cracked product effluent from the radiant section is quenched through transfer line exchangers (TLXs) and oil and/or water quench towers, then fractionated and purified in the downstream processes to separate desired products. In general, ethylene is the major and the most desired of the products.

Metal alloys containing high nickel, iron and chromium are widely used in industry as the construction materials for pyrolysis furnace reactors because such alloys withstand the high temperature and extreme environmental operations. However, nickel and iron are also well-known catalysts for reactions leading to the formation of coke.

Coke deposits are the by-products of the cracking reactions. Even though the reactions leading to coke deposition are not significant relative to those producing the major desired products, the amount of the coke formed is enough to make the coke deposition a major limitation in the operation of pyrolysis furnaces. Fouling of the furnace reactors and TLXs (hereinafter collectively referred to as "pyrolysis furnaces") occurs because of the coke deposition. Coke deposition decreases the effective cross-sectional area of the process stream, which increases the pressure drop across the pyrolysis furnaces. The pressure buildup in the reactor adversely affects the yield of desired products, particularly ethylene. Additionally, because the coke formed on the inside of reactor tubes is a good thermal insulator, the buildup of coke requires a gradual increase in furnace firing to ensure enough heat transfer to maintain the desired conversion level. These higher temperatures accelerate reactor tube deterioration and shorten tube life.

Depending on the coke deposition rate, cracking operations must be periodically terminated or shut down for cleaning. Cleaning operations are carried out either mechanically or by passing steam and/or air through the coil to burn out the coke buildup. In addition to the periodic cleaning, crash shutdowns are sometimes required because of dangerous situations resulting from coke buildup in the pyrolysis furnaces. Run length, which is the operation time between the cleanings, may average from as little as one week to as long as four months depending in part upon the rate of fouling of the pyrolysis furnaces. Therefore, any process improvement or chemical treatment that could reduce coke deposition and thus increase run length would lead to higher production capacities, fewer days lost due to cleaning and lower maintenance costs.

Research has been carried out to understand the mechanisms under which coke formation occurs and to search for solutions to reduce or eliminate coke deposition. Coke can generally be classified into two categories: catalytic and non-catalytic coke. Dehydrogenation reactions catalyzed by metals, such as nickel and iron, are the origins of catalytic coke, while non-catalytic coke is the product of certain radical-type reactions. It is generally believed that the metal-catalyzed reactions play a more significant role in overall coke formation and deposition than the non-catalytic reactions. Thus, suppression of metal-catalyzed reactions would significantly lower overall coke formation and deposition.

Significant effort has been exerted over the past twenty years in developing coke inhibitors, i.e., chemical additives which suppress coke formation. Coke inhibitors work by passivating catalytically active metal sites through chemical bonding interactions, and/or forming a thin layer to physically isolate the metal sites from coke precursors in a process stream, and/or interfering with those radical reactions leading to coke formation by blocking active radical sites on surfaces.

Sulfur-containing species, such as sulfides (hydrogen sulfide ($H_2S$), dimethyl sulfide (DMS), dimethyl disulfide (DMDS)), mercaptans, and polysulfides, have been conventionally used in industrial practice to treat pyrolysis furnaces. Sulfur compounds have generally been used for CO formation control and coke formation inhibition. It is believed that sulfur forms a metal sulfide passivating layer on reactor metal surfaces and that this sulfide layer isolates gas phase coke precursors from active metal sites on surfaces, thereby resulting in coking reduction.

In addition to sulfur, phosphorus-based additives have also been reported to prevent coke formation in pyrolysis furnaces. Some of these phosphorus-containing additives contain sulfur bonded to phosphorus. Compounds having both sulfur and phosphorus discussed in the literature have sulfur to phosphorus atomic ratios of 4 or less.

The present inventors have discovered that more effective treatment procedures can be achieved by varying the ratio of sulfur to phosphorus. While both elements have been shown to be effective in commercial and lab units, their relative ratio has not been taken into consideration. Due to the wide variety of furnaces and their operating conditions, it is believed that certain circumstances will arise where the ratio might become critical to optimizing additive performance. No known literature or use has been reported where more sulfur, with respect to phosphorus, would be beneficial.

The use of sulfur compounds to control coke formation during the production of ethylene is shown in the prior art. For instance, U.S. Pat. No. 4,116,812 discloses a process of inhibiting fouling at elevated temperatures of 500° F. to 1500° F. by adding organo-sulflur compounds. In addition, U.S. Pat. No. 5,463,159 discloses a method of treating ethylene furnaces with hydrogen sulfide under a hydrogen and steam-containing environment to reduce CO and/or coke formation.

Likewise, phosphorus-containing formulations have been recognized as suppressants for coke formation in pyrolysis furnaces. The following patents disclose phosphorus compounds for inhibiting the formation of coke in pyrolysis furnaces. U.S. Pat. No. 3,531,394 discloses a method of reducing coke formation by providing for the presence of phosphorus and/or bismuth-containing compounds in the cracking zone. Elemental phosphorus is disclosed to be a coke preventative aid in refining units in U.S. Pat. No. 3,647,677. U.S. Pat. Nos. 4,024,050 and 4,024,051 disclose a method of inhibiting coke formation in petroleum refining processes using phosphate and phosphite esters, as well as inorganic phosphorus compounds. U.S. Pat. No. 4,105,540 teaches that phosphate and phosphite mono and diesters in small amounts function as antifoulant additives in ethylene furnaces. Certain phosphite esters, phosphate esters and thiophosphate esters are disclosed in U.S. Pat. No. 4,542,253 as being effective for reducing fouling in ethylene furnaces. U.S. Pat. No. 4,551,227 discloses a method of inhibiting coke formation in ethylene furnaces by treating the furnaces with a combination of tin- and phosphorus-containing compounds, or antimony- and phosphorus-containing compounds, or tin-, antimony- and phosphorus-containing compounds. U.S. Pat. No. 4,835,332 discloses a method of reducing fouling in ethylene furnaces by using triphenylphosphine. Phosphorothioates are disclosed in U.S. Pat. No. 5,354,450 as effective in the inhibition of coke formation in ethylene furnaces. Phosphoric triamides are disclosed as coke inhibitors for ethylene furnaces in U.S. Pat. No. 5,360,531.

Although sulfur and phosphorus compounds are known coke suppressant additives for pyrolysis furnaces, the use of a mixture of additives to provide a sulfur to phosphorus atomic ratio of 5 or greater is not disclosed in the prior art. The benefit of using an excessive amount of sulfur over phosphorus is not recognized in the prior art either. Accordingly, it is the object of this invention to provide an improved method for the inhibition of coke formation in pyrolysis furnaces using a combination of sulfur- and phosphorus-containing compounds having an atomic ratio of sulfur to phosphorus of at least 5.

SUMMARY OF THE INVENTION

The method of the invention calls for treating a pyrolysis furnace with a combination of sulfur- and phosphorus-containing compounds having a sulfur to phosphorus atomic ratio of at least 5 to reduce coke deposition. This treatment method provides a uniform and effective passivation layer on the surfaces of pyrolysis furnaces, thereby effectively inhibiting the formation of coke.

DETAILED DESCRIPTION OF THE INVENTION

Figure 1:
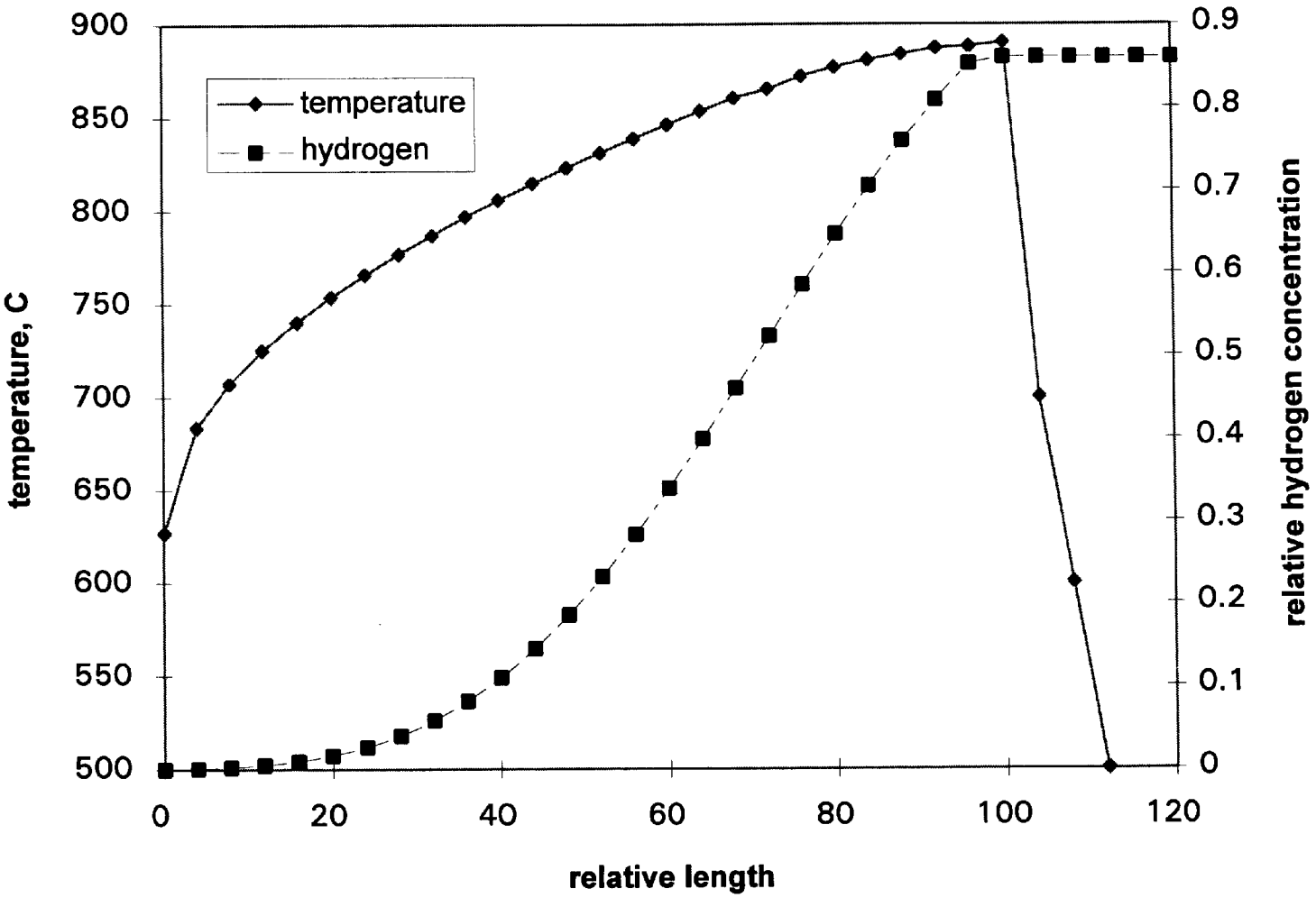
FIG. 1 shows the temperature and hydrogen concentration profiles along the furnace reactor and transfer line exchanger.

The present invention is directed to a method for inhibiting coke deposition in a pyrolysis furnace which comprises treating the pyrolysis furnace with a combination of sulfur- and phosphorus-containing compounds, which has a sulfur to phosphorus atomic ratio of 5 or greater. The sulfur-containing compounds include, but are not limited to, hydrogen/alkyl/aryl sulfides (such as hydrogen sulfide, dimethyl sulfide, dibenzyl sulfide and ethyl benzyl sulfide), mercaptans (such as ethanethiol and thiophenol), disulfides (such as dimethyl disulfide and dibenzyl disulfide), polysulfides, and sulfur oxides (such as sulfoxides, sulfones, sulfonic acids and esters and sulfate esters). The phosphorus-containing compounds include, but are not limited to, mono-, di-, and tri-substituted organo-phosphates, -phosphites, -phosphines, thiophosphates, thiophosphites, phosphonates, and phosphoric triamides, and inorganic phosphorus compounds (such as phosphoric acid and its salts/derivatives).

In accordance with the method of this invention, an effective amount of a combination of sulfur- and phosphorus-containing compounds, which in total has a sulfur to phosphorus atomic ratio of at least 5, is brought in contact with the surfaces of a pyrolysis furnace for an effective period of time prior to hydrocarbon feed to the furnace (pretreatment). The effective pretreatment time can vary from about 30 minutes to 20 hours, preferably from about 1 to 10 hours, and most preferably from about 1 to 4 hours. The compounds are in contact with the surfaces of the pyrolysis furnace at a temperature of about 400 to 1000° C. and preferably from about 600 to 950° C. The addition of a combination of sulfur andphosphorus-containing compounds having a sulfur to phosphorus ratio of at least 5 may or may not continue during hydrocarbon feed to the furnace. An effective passivation layer will be produced on the surfaces through this contact, which prevents the coking reactions on the surfaces during hydrocarbon feed.

The sulfur and phosphorus compound(s) can be added to the furnace anywhere before and up to the crossover point (i.e. the point just before entry into the radiant section). During pretreatment, the sulfur/phosphorus combination will need to be carried into the furnace with the steam as a carrier. Other more complicated injection means could be envisioned where the combination is added to the hydrocarbon feed line and a reasonable, inert carrier gas (e.g. steam, nitrogen, etc.) is used. If added during the hydrocarbon feed, the chemical treatment may last throughout the entire run, may be added intermittently, or may be stopped at any time.

The delivery of this combination of sulfur- and phosphorus-containing compounds may be accomplished by adding a pre-formulated mixture of the sulfur- and phosphorus-containing compounds to the pyrolysis furnace, or by injecting the sulfur- and phosphorus-containing compounds separately at the same time. In either case, the sulfur- and phosphorus-containing compounds have to contact the surfaces in the pyrolysis furnace at the same time with a sulfur to phosphorus atomic ratio of at least 5 during the pretreatment.

When a pre-formulated mixture of sulfur- and phosphorus-containing compounds is used, the mixture of the sulfur- and phosphorus-containing compounds may be added into the dilution steam and/or hydrocarbon feed, and/or the mixture of both. It is preferred to add this combination to the furnace anywhere after the location where the hydrocarbon and dilution steam are mixed together, but before the inlet to the radiant section. The most preferred addition location is at the crossover from the convection section to the radiant section. For furnaces which are limited by TLX fouling, the combination may also be added just before the TLX. The choice of injection location has to ensure that no adverse effects, such as fouling or corrosion in the convection section, will occur from the use of the treatment method.

When injecting sulfur- and phosphorus-containing compounds separately at the same time, the sulfur- and the phosphorus-containing compounds may be added at the same or different locations.

Improved passivation will be obtained when contacting the combination of sulfur- and phosphorus-containing compounds with a coke-free surface in a pyrolysis furnace. Therefore, the hot standby (i.e., the time period after a thermal decoke and/or a mechanical cleaning of the pyrolysis furnace and prior to hydrocarbon feed) is the most proper time to perform this chemical treatment. This application method is so-called pretreatment.

The pretreatment dosage ranges from about 1 part per million (ppm) up to about 1,000 ppm of phosphorus on the basis of the process mass flow. Preferred dosage during pretreatment is from about 1 to about 100 ppm of phosphorus. The most preferred pretreatment dosage is from about 10 to about 100 ppm. Generally, a higher dosage is desired during pretreatment than the dosage during hydrocarbon feed.

The present invention effectively and uniformly passivates the surfaces of pyrolysis furnaces, and thus, significantly reduces coke formation and deposition. Even though a sulfur- or a phosphorus-containing compound or a sulfur/phosphorus-containing compound alone can be used for coking reduction, the overall effectiveness from the inlet of the furnace reactors to the front part of the TLXs is significantly improved when applying sulfur- and phosphorus-containing compounds with an excess of sulfur to phosphorus, such that the sulfur to phosphorus atomic ratio is 5 or greater. Excess sulfur can be added by blending a sulfur-containing compound into a phosphorus- or a phosphorus/sulfur-containing additive formulation.

The following thermodynamic calculations, kinetic considerations and experimental examples serve to illustrate the importance and advantages of the addition of an excessive amount of sulfur-containing species to a phosphorus-containing additive, which results in a formulation of a sulfur to phosphorus atomic ratio of 5 or greater.

THERMODYNAMIC AND KINETIC CONSIDERATIONS

In an industrial furnace, the process stream temperature and composition changes along the length of the furnace reactors and TLXs due to heating/cooling and pyrolysis reaction progress. FIG. 1 shows the typical temperature and hydrogen concentration profiles along a furnace reactor and a TLX. As indicated, the early part of the furnace reactor is in an environment of lower temperature and lower hydrogen concentration, while the later part of the reactor is at higher temperature and higher hydrogen concentration. In the TLX, a drastic drop in temperature is developed as a result of indirect quenching of the process stream, while the hydrogen concentration remains high.

It is a common belief that passivation by sulfur-containing compounds is accomplished through formation of a thin layer of metal sulfide on equipment surfaces, which prevents the interaction between the gas phase coke precursors and active coking reaction sites on equipment surfaces. Similarly, the application of phosphorus-containing compounds generates protective metal phosphides or metal phosphates on equipment surfaces. An effective passivation will depend on the ease of forming the passivation layers and the stability of the metal sulfides, phosphides and phosphates under equipment conditions.

Figure 2:
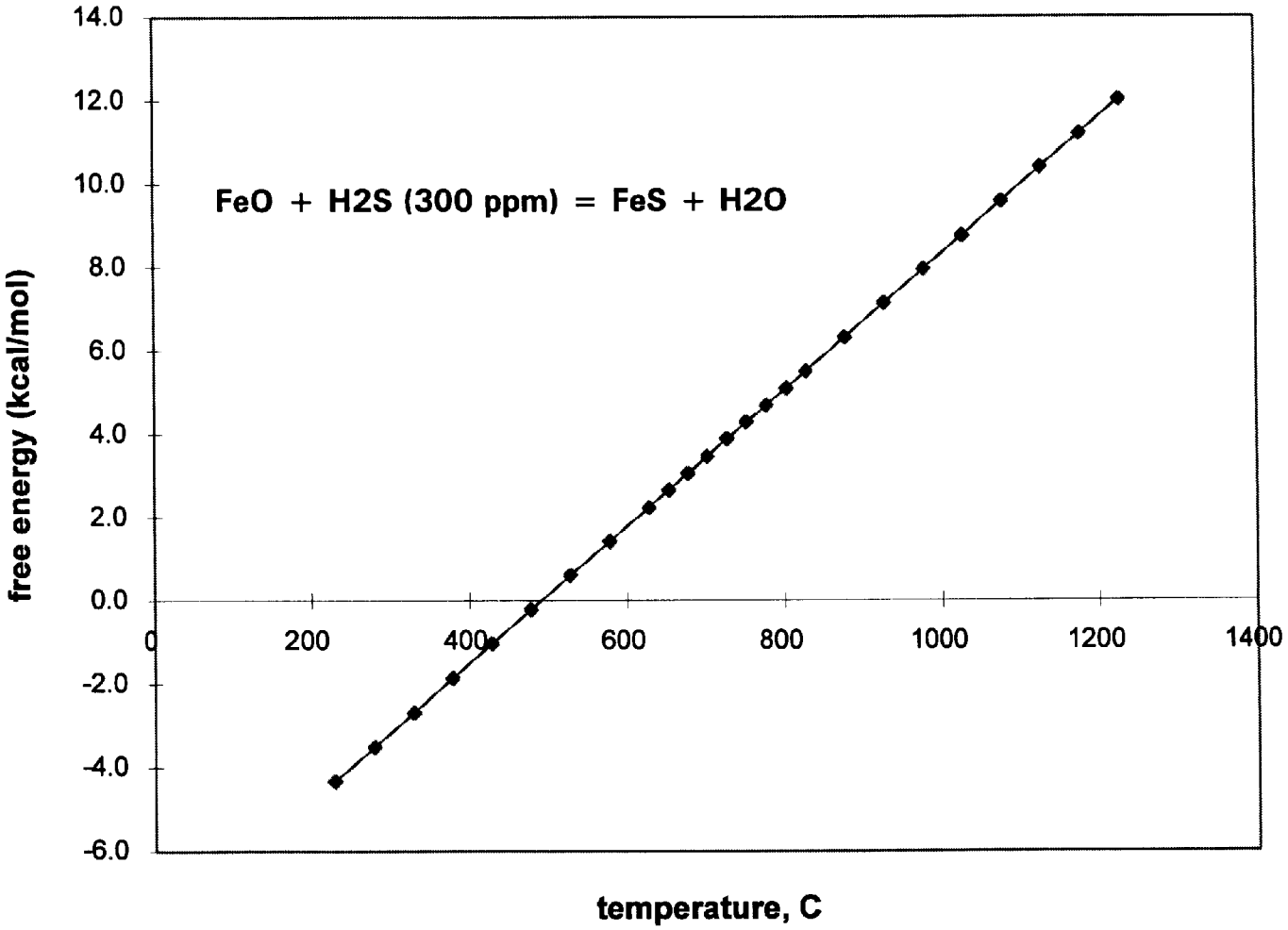
FIG. 2 shows the free energy of iron sulfide formation reaction as a function of temperature on an oxidized metal surface.
Figure 3:
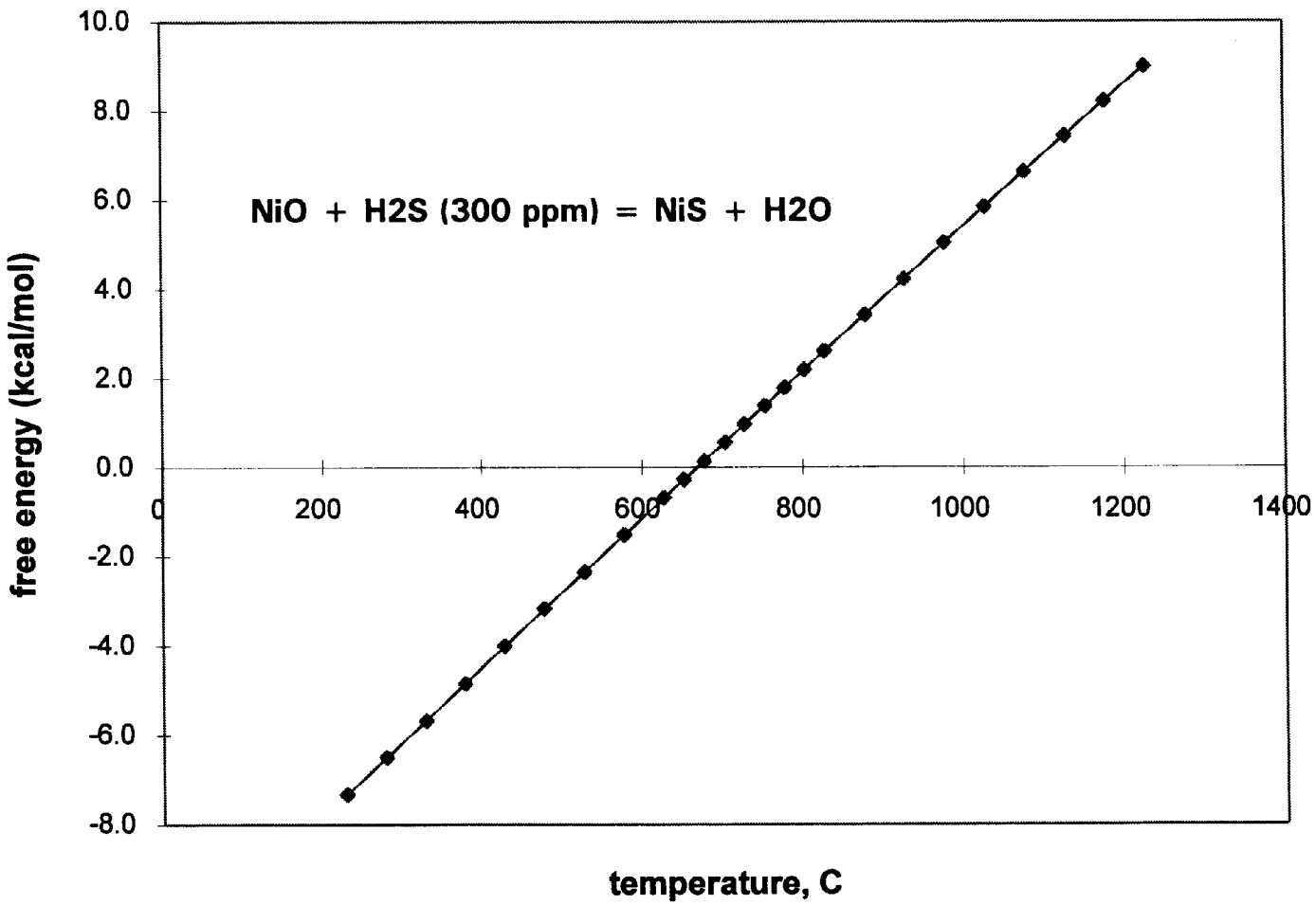
FIG. 3 shows the free energy of nickel sulfide formation reaction as a function of temperature on an oxidized metal surface.

The free energy for the formation reactions of iron and nickel sulfides on an oxidized metal surface is calculated as a function of temperature, and the results are shown in FIGS. 2 and 3, respectively. From the graphs, it is suggested that the formation of metal sulfides from the interaction of hydrogen sulfide ($H_2S$) and metal oxides is less favorable at higher temperature. For a $H_2S$ concentration of 300 ppm, the formation of Fe and Ni sulfides are possible only under 500 and 670° C., respectively. Considering the temperature profile in the later part of a furnace reactor, it is apparent that the metal sulfides are not able to be formed in that part of the reactor, or a stable passivation cannot be obtained with solely a sulfur-containing reagent in that part of the reactor.

During a cracking operation, a highly reductive environment is created due to the presence of hydrocarbon feed and cracking reaction products. Under this environment, the reactor surface is in a more reduced state, and $H_2S$ or phosphine ($PH_3$) is in direct contact with a metal dominated surface. The products from the interaction are metal sulfides and phosphides. Free energy calculations for the formation reactions of metal sulfides and phosphides from these interactions/reactions are given in FIGS. 4 through 7.

Figure 4:
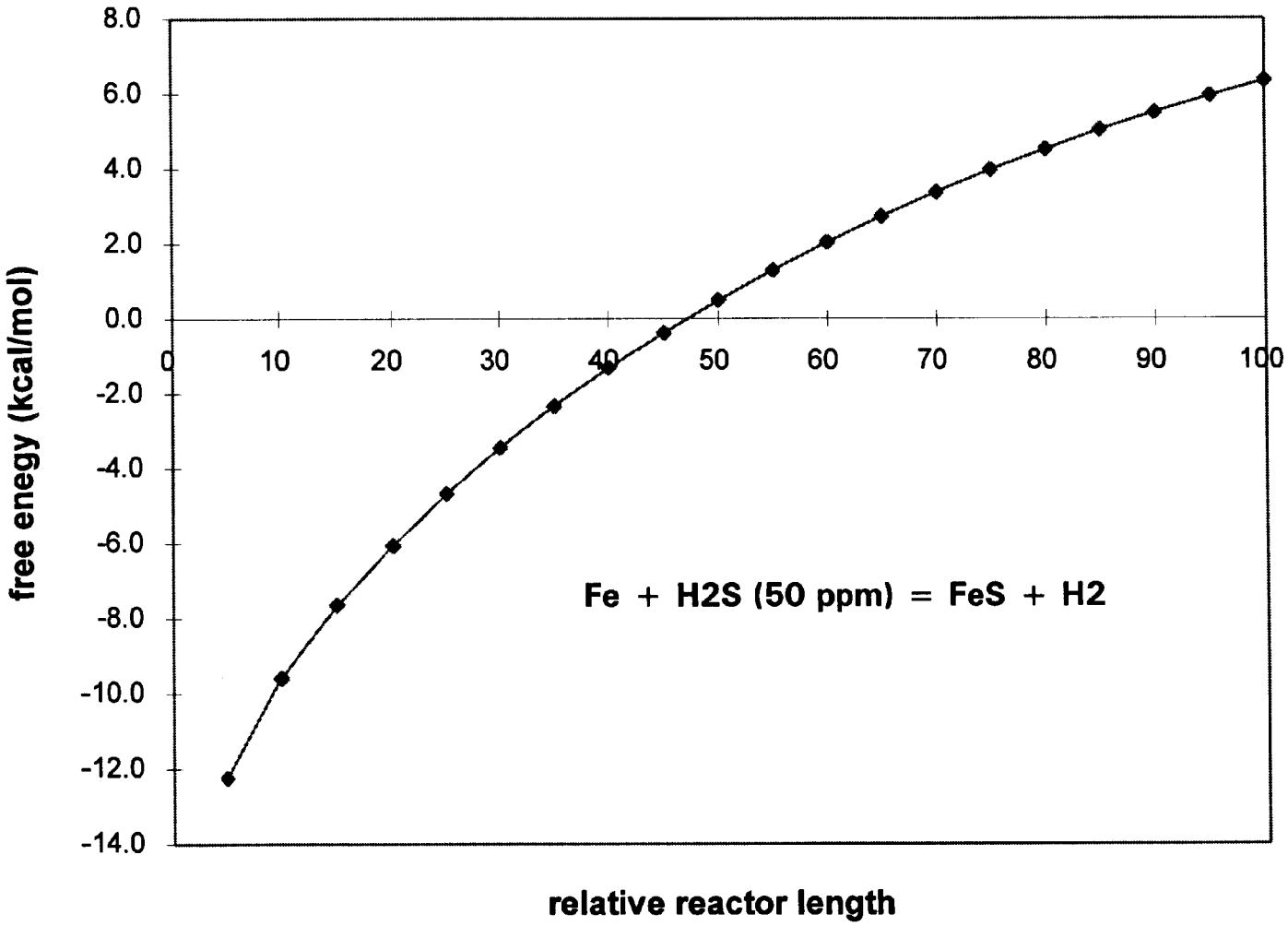
FIG. 4 shows the free energy of iron sulfide formation reaction as a function of relative reactor length during a cracking operation.
Figure 5:
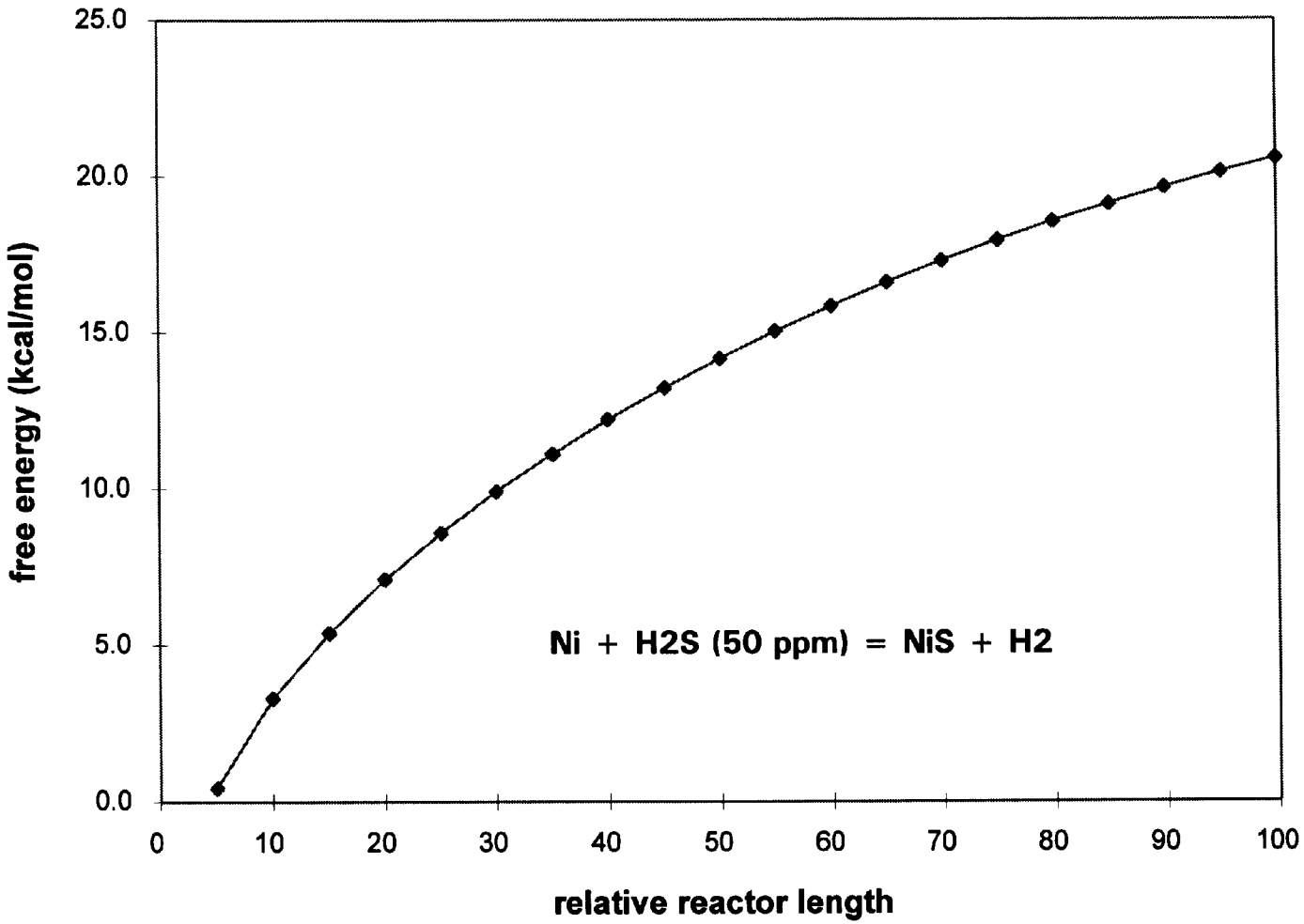
FIG. 5 shows the free energy of nickel sulfide formation reaction as a function of relative reactor length during a cracking operation.

For a $H_2S$ concentration of 50 ppm, FIG. 5 illustrates that under the cracking operation, the formation of nickel sulfide is thermodynamically unfavorable in the whole pyrolysis furnace, thus eliminating the possibility of using sulfur-containing reagents to passivate nickel-dominated metal alloy surfaces. For iron, the same is true for the second half of the furnace, while the formation of iron sulfide is thermodynamically feasible in the first half of the furnace, as shown in FIG. 4. Thus, it is clear that sulfur-containing reagents alone are not overly effective passivation materials during cracking operations for an alloy pyrolysis furnace with high nickel content.

Figure 6:
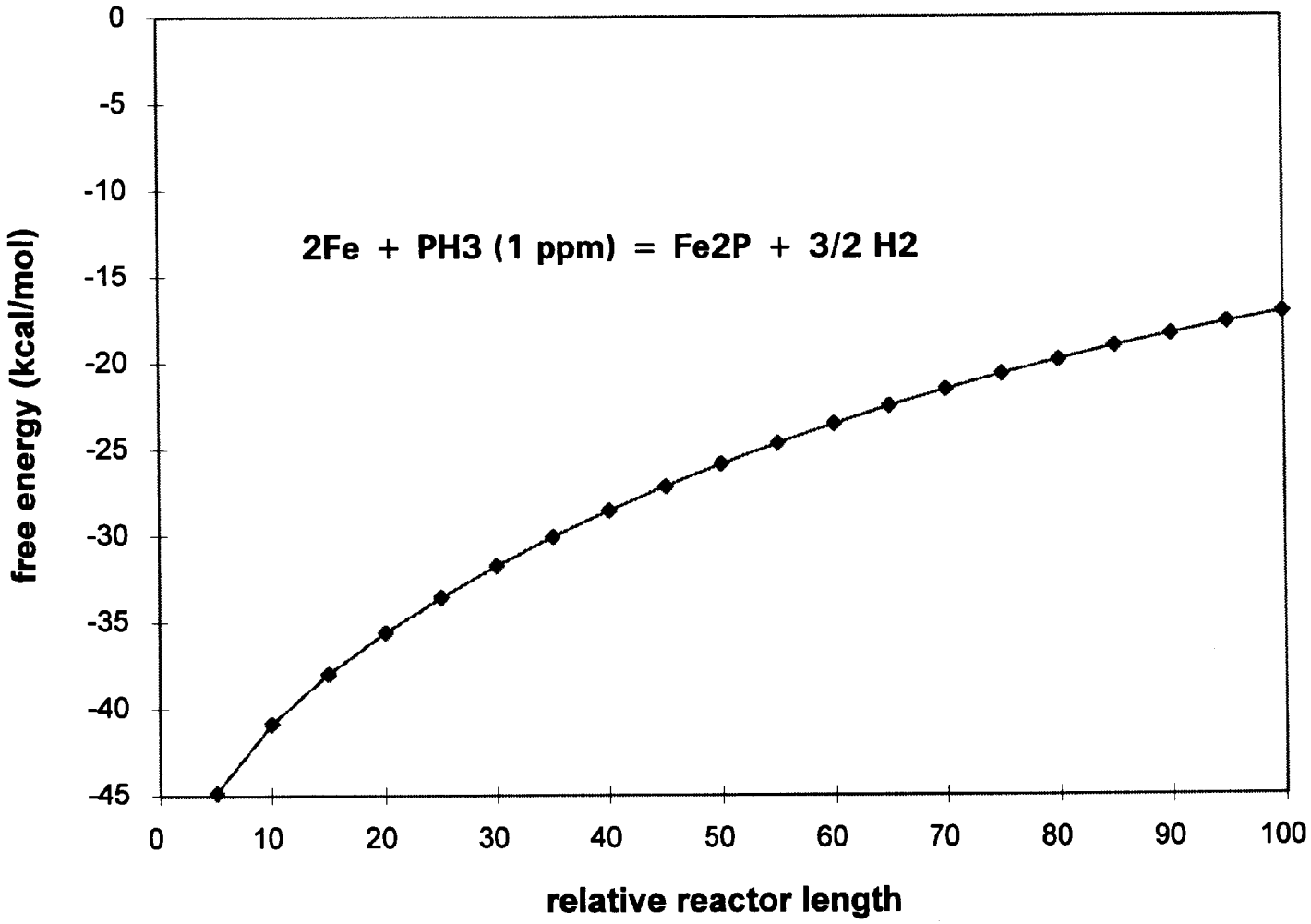
FIG. 6 shows the free energy of iron phosphide formation reaction as a function of relative reactor length during a cracking operation.
Figure 7:
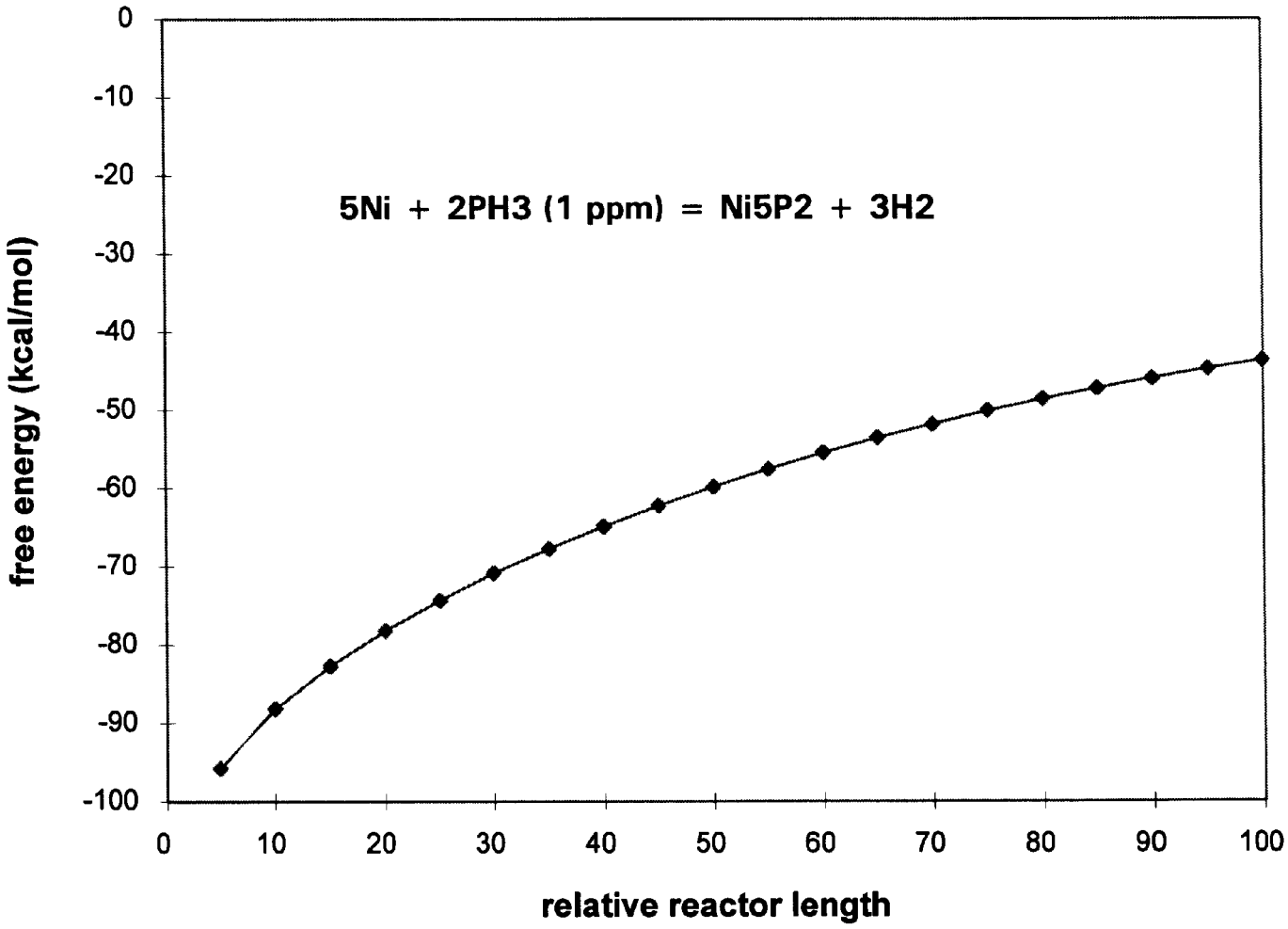
FIG. 7 shows the free energy of nickel phosphide formation reaction as a function of relative reactor length during a cracking operation.

On the other hand as shown in FIGS. 6 and 7, $PH_3$ thermodynamically seems to be a superior passivation reagent. Based on the thermodynamic calculations, a very favorable passivation environment can be created by adding a trace amount of $PH_3$ (1 ppm), and this situation applies to the whole furnace.

The above calculations take into account the thermodynamic aspect of the reactions of $H_2S$ and $PH_3$ with metal alloy surfaces to yield metal sulfides and phosphides. The other equally important aspect to consider is the kinetics of the interactions of a passivation reagent with the equipment surfaces. The rate limiting factor for metal sulfides or phosphides formation will be a combined consideration of both the thermodynamic and kinetic aspects.

It is well-established in the prior art that sulfidation reaction processes occur very fast over metal or metal oxide surfaces so that the sulfidation reaction rate is generally controlled by thermodynamic parameters. This kinetic character of sulfidation reactions makes them very competitive when sulfur-containing species are present with other passivation reagents, such as phosphorus-containing compounds. As demonstrated below, the presence of sulfur-containing species decreases the extent of the interaction between phosphorus species and surfaces, suggesting that the sulfur species effectively competed for the surface active sites with the phosphorus species. Because of the fast sulfidation reaction rate, the sulfidation reactions are very sensitive to the concentration of sulfur-containing species, and thus sufficient supply of sulfur is critical for metal sulfide formation.

This kinetic advantage of sulfidation reactions makes sulfur species the top choice of passivation reagents in an environment where passivation reaction is limited by kinetic factors. This is the situation in the front part of a furnace reactor and in the TLX. Therefore, a combination of sulfur- and phosphorus-containing compounds with an excessive amount of sulfur will provide a thermodynamically and kinetically sound passivation reagent formulation. Their co-presence compensates each other, and ensures that surfaces are fully covered with an effective sulfur/phosphorus-containing passivation layer in any scenario.

EXAMPLES

The following examples are intended to be illustrative of the present invention and to teach one of ordinary skill how to make and use the invention. These examples are not intended to limit the invention or its protection in any way.

In the following examples, triphenylphosphine (TPP), triphenylphosphine oxide (TPPO) and tripiperidinophosphine oxide (TPYPO) were used as model compounds to illustrate the interaction of phosphorus species with equipment surfaces. The extent of the interaction of these model compounds was measured by $PH_3$ formation, that is, the more interaction/reaction there was between TPP, TPPO or TPYPO and the surfaces, the more $PH_3$ would be formed, and vice versa. The following examples show that the interaction of TPP, TPPO and TPYPO with the surfaces decreased when a sufficient amount of sulfur species was added to the phosphorus compounds as passivation additives.

The experiments were conducted with a laboratory setup which simulated the operation in an industrial furnace. Steam and hydrocarbon feed were fed through a high nickel/chromium alloy, Incoloy 800, tubular reactor with a ⅜" outside diameter. The cracking zone of the reactor was maintained at a temperature between 800 to 860° C. during each experiment. At the exit of the reactor, the cracked product flow was quickly cooled down as it passed through several quench/cooling glassware setups. The effluent gaseous product was further washed with a caustic bath and dried with a molecular sieve filter. The dried product gas was then analyzed using gas detection tubes for $PH_3$. $PH_3$ formation rate was determined on a relative scale. The model phosphorus compounds and sulfur species were formulated with solvent, and the solutions were used as additives.

Example 1

Dimethyl disulfide (DMDS) and hexamethyldisiloxane as co-additives were separately blended in a solution of 5% TPP. The amount of each co-additive was adjusted so that a S:P or Si:P atomic ratio of unity was obtained. These blending solutions were then tested for the effect of sulfur or silicon on $PH_3$ formation. The results are summarized below in Table 1.

TABLE 1

| Additive | Relative $PH_3$ formation rate |
|---|---|
| TPP only | 100 |
| TPP and DMDS | 68 |
| TPP and hexamethyldisiloxane | 94 |

As shown in Table 1, a notable reduction in $PH_3$ formation was observed when DMDS and TPP were both present, indicating that DMDS actively participated in the surface interactions, and effectively competed with TPP for surface active sites.

Example 2

A significant reduction in $PH_3$ formation was also observed when propyldisulfide (PDS) was used in place of DMDS in a TPP-containing solution, indicating that the reduction in $PH_3$ formation was a general phenomenon for sulfur-containing species.

Example 3

When 1% PDS was added to a solution containing 1% TPYPO, $PH_3$ formation was reduced by 50%, indicating that the reduction in $PH_3$ by sulfur species was universal for all phosphorus compounds.

Example 4

Figure 8:
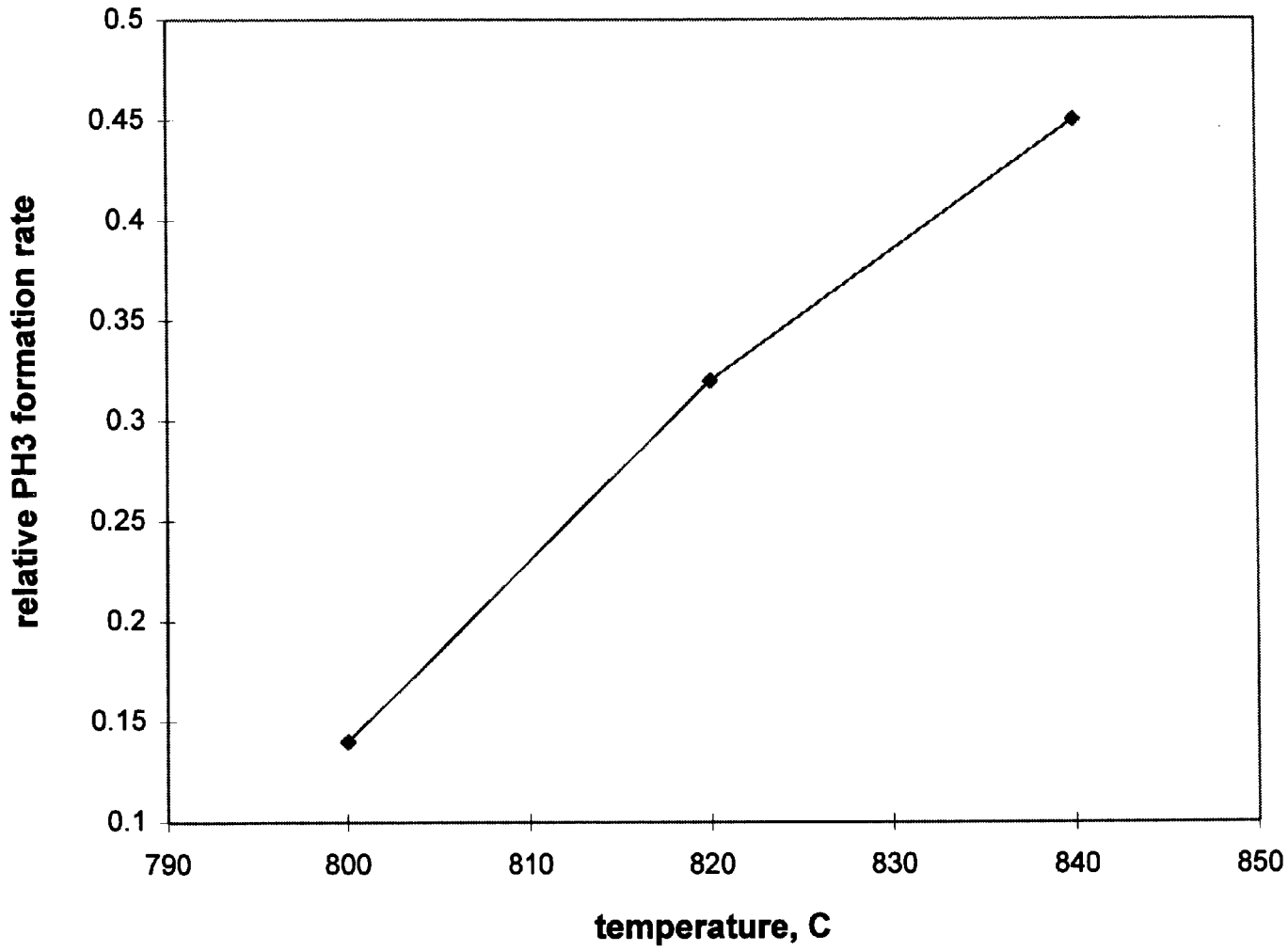
FIG. 8 shows the phosphine reduction by propyldisulfide as a function of temperature.

FIG. 8 shows how the sulfur effect on $PH_3$ formation changes with temperature. At 820° C., a reduction in $PH_3$ formation by 85% was observed when an additive solution of 1% TPPO and 1% PDS was used. The reduction percentage decreased to 55% when the temperature was increased to 840° C. This indicates that the interaction of sulfur species with the surfaces or the competition of sulfur with phosphorus species weakened as the temperature rose. This experimental observation supports the thermodynamic calculation about the stability of metal sulfides as a function of temperature.

Example 5

Figure 9:
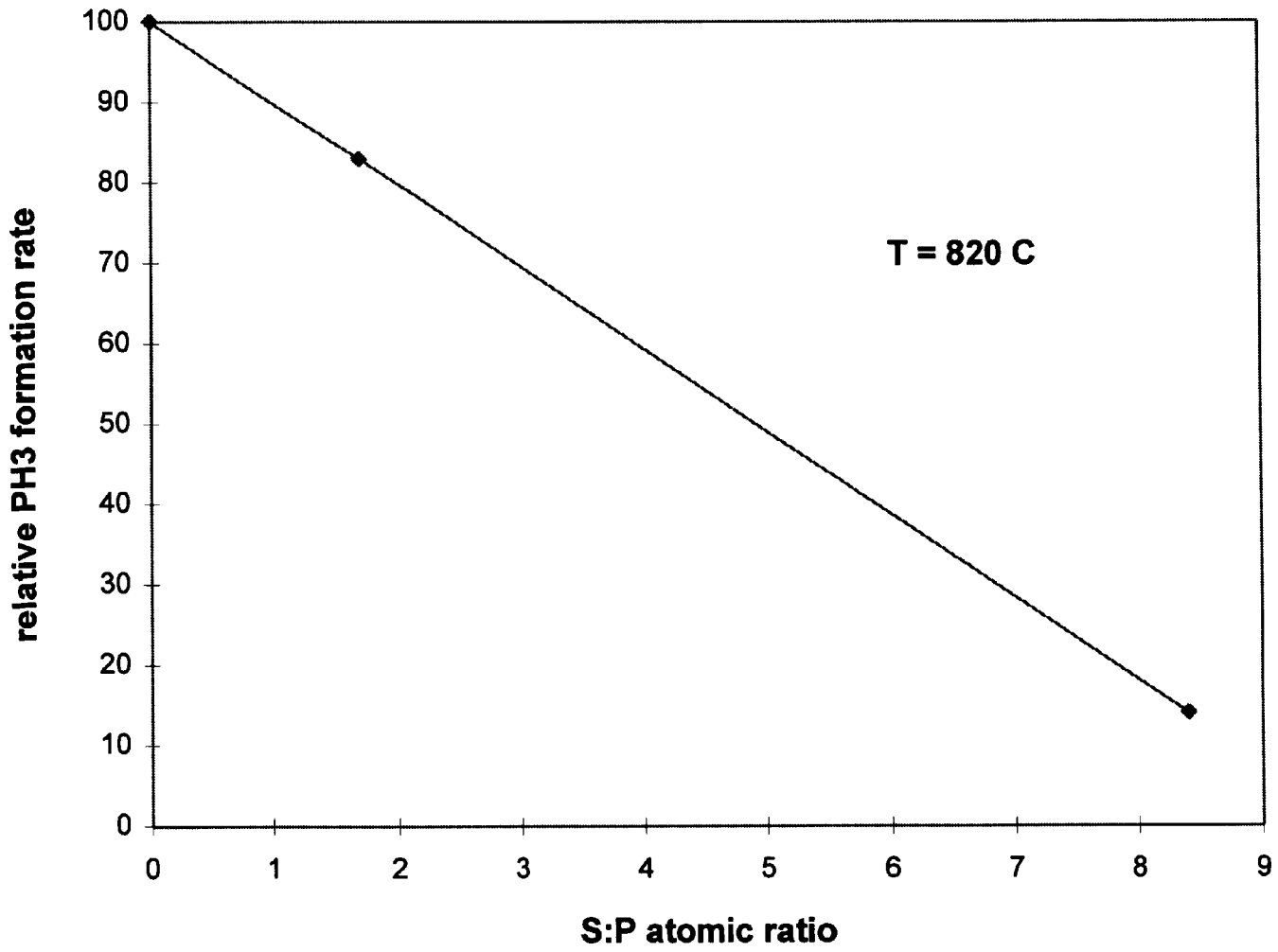
FIG. 9 shows the phosphine reduction by dimethyl disulfide at different sulfur to phosphorus atomic ratios.

DMDS was blended in a TPP-containing solution in several sulfur to phosphorus ratios at a temperature of 820° C., and the results are plotted in FIG. 9. Extrapolation of this plot yields an intersection on the X-axis at a sulfur to phosphorus ratio of about 10. This means that a sulfur to phosphorus ratio of 10 or higher is sufficient to have sulfur dominate the surface interaction under this condition. A sulfur to phosphorus ratio of 5 resulted in a reduction in $PH_3$ formation by 50%, indicating that at this ratio, a balance between sulfur and phosphorus is achieved with regard to the competitive interaction with the surfaces. Based on Example 4, a sulfur to phosphorus ratio greater than 5 may be required at higher temperature to maintain the balance between sulfur- and phosphorus-related surface interaction. Accordingly, a sulfur to phosphorus ratio of 5 or greater is desired to obtain an effective sulfur/phosphorus surface passivation.

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims.

What is claimed is:

1. A method of inhibiting coke deposition in a pyrolysis furnace which processes hydrocarbon feed and steam comprising the step of treating the pyrolysis furnace with an effective inhibiting amount of a combination of sulfur- and phosphorous-containing compounds having a total sulfur to phosphorous atomic ratio of at least 5.

2. The method of claim 1 wherein the pyrolysis furnace is treated prior to introducing hydrocarbon feed to the furnace.

3. The method of claim 2 wherein the pyrolysis furnace is treated for about 30 minutes to about 20 hours.

4. The method of claim 2 wherein the pyrolysis furnace is treated for about 1 hour to about 10 hours.

5. The method of claim 2 wherein the pyrolysis furnace is treated for about 1 hour to about 4 hours.

6. The method of claim 1 wherein the combination of sulfur- and phosphorus-containing compounds are blended together before treating the pyrolysis furnace.

7. The method of claim 1 wherein the combination of sulfur- and phosphorus-containing compounds are added to the pyrolysis furnace simultaneously to treat the pyrolysis furnace.

8. The method of claim 1 wherein the effective inhibiting amount is from about 1 to about 1000 ppm of phosphorus based on the combined weight of the hydrocarbon feed and steam.

9. The method of claim 1 wherein the effective inhibiting amount is from about 1 to about 100 ppm of phosphorus based on the combined weight of the hydrocarbon feed and steam.

10. The method of claim 1 wherein the effective inhibiting amount is from about 10 to about 100 ppm of phosphorus based on the combined weight of the hydrocarbon feed and steam.

* * * * *